United States Patent [19]

Nakagawa et al.

[11] Patent Number: 4,922,663

[45] Date of Patent: May 8, 1990

[54] SANDPAPER CLAMP MECHANISM FOR ORBITAL FINISHING SANDER

[75] Inventors: Atsushi Nakagawa; Kazumi Takeishi, both of Katsuta, Japan

[73] Assignee: Hitachi Koki Company, Ltd., Tokyo, Japan

[21] Appl. No.: 373,553

[22] Filed: Jun. 30, 1989

[30] Foreign Application Priority Data

Jul. 1, 1988 [JP] Japan ..... 63-88354[U]

[51] Int. Cl.[5] ..... B24B 23/00

[52] U.S. Cl. ..... 51/170 TL; 51/170 MT; 51/387

[58] Field of Search ..... 51/170 TL, 170 MT, 170 R, 51/387, 382, 384

[56] References Cited

U.S. PATENT DOCUMENTS

| | | | |
|---|---|---|---|
| 2,775,076 | 12/1956 | Roods | 51/170 MT |
| 3,375,616 | 4/1968 | Scott et al. | 51/170 MT |
| 3,822,518 | 7/1974 | Sjostrand . | |
| 4,075,793 | 2/1978 | Vogel et al. | 51/170 MT |

FOREIGN PATENT DOCUMENTS

| | | |
|---|---|---|
| 6609661 | 8/1972 | Fed. Rep. of Germany . |
| 2511392 | 9/1982 | Fed. Rep. of Germany . |

*Primary Examiner*—Roscoe V. Parker

*Attorney, Agent, or Firm*—Pollock, Vande Sande & Priddy

[57] ABSTRACT

An orbital finishing sander includes a sandpaper clamp mechansim which has a sandpaper holder angularly movably supported on a bottom plate. A sanding sheet placed over a platen attached to the bottom plate is gripped by gripping teeth of the sandpaper holder under the bias of a spring. When a lever mounted on a frame of the sander is turned through about 90°, a presser on one end of the lever successively cams slanted and flat surfaces of the sandpaper holder downwardly to lift the gripping teeth off the bottom plate, thus releasing the sanding sheet. The sanding sheet is removed, and a new sanding sheet is placed on the platen, after which the lever is turned back to allow the gripping teeth to grip the new sanding sheet under the spring force.

4 Claims, 3 Drawing Sheets

SANDPAPER CLAMP MECHANISM FOR ORBITAL FINISHING SANDER

BACKGROUND OF THE INVENTION

1. Field of the Invention

The present invention relates to a sandpaper clamp mechanism for use in a finishing tool such as a portable electrically-operated orbital finishing sander which employs a sanding sheet or sandpaper for sanding a workpiece.

2. Prior Art

Finishing tools such as orbital finishing sanders include sandpaper clamps for clamping sanding sheets to platens or pads. One typical sandpaper clamp comprises a spring-clamping device or sandpaper holder which is mounted on a bottom plate and biased by a coil spring for clamping each end of a sanding sheet to a platen or pad. The sandpaper holder includes gripping teeth biased to hold the sanding sheet to the platen under the force of the coil spring disposed around a shaft. To replace the sanding sheet with a new one, a lever attached to the gripping teeth is manually pushed by the user against the bias of the coil spring to turn the sandpaper holder until the gripped end of the sanding sheet is released. Then, a new sanding sheet is placed over the platen and then clamped in position by the sandpaper holder, while the old sanding sheet is being replaced, the lever of the-sandpaper holder must be continuously pushed by a finger of one hand and the new sanding sheet must be inserted and held in position between the bottom plate and the gripping teeth by fingers of the other hand. The fingers used during the sanding sheet replacement tend to be tired or get hurt. It is time-consuming and needs skill to replace the old sanding sheet. Sometimes, the new sanding sheet may not be positioned accurately.

SUMMARY OF THE INVENTION

It is an object of the present invention to provide a sandpaper clamp mechanism for use in a finishing tool, which allows a sheet of sandpaper to be replaced with a new one quite easily in a short period of time.

According to the present invention, there is provided a sandpaper clamp mechanism for use in a finishing tool, comprising a frame, a bottom plate connected to the frame in spaced relation thereto, a platen for supporting a sanding sheet thereon, the platen being attached to a lower surface of the bottom plate, a sandpaper holder angularly movably mounted on the bottom plate, the sandpaper holder having gripping teeth on one end, a flat surface remote from the gripping teeth, and a slanted surface contiguous to the flat surface, the sandpaper holder being angularly movably between a first position in which the gripping teeth hold the sanding sheet against the bottom plate and a second position in which the gripping teeth are spaced from the bottom plate to release the sanding sheet, a spring acting between the sandpaper holder and the bottom plate for normally urging the sandpaper holder into the first position, and a lever angularly movably mounted on the frame and having a presser on one end thereof, the lever being angularly movable between a third position in which the presser is spaced from the slanted surface to allow the sandpaper holder to remain in the first position under the bias of the spring and a fourth position in which the presser pushes the flat surface to lift the sandpaper holder into the second position, the presser successively camming the slanted and flat surfaces while the lever is moving from the third position to the fourth position.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 1:
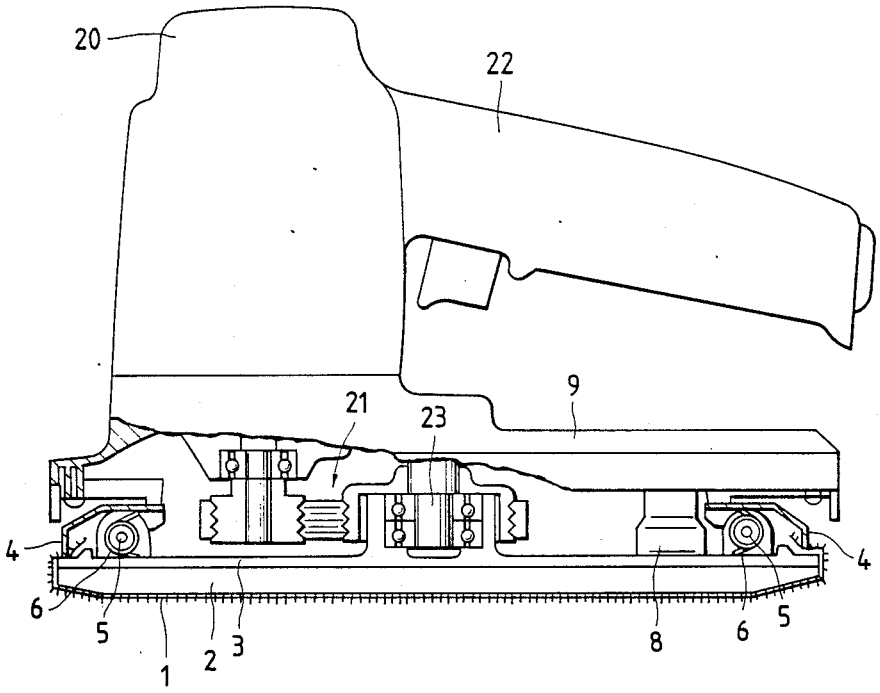
FIG. 1 is a side elevational view, partly cut away, of an orbital finishing sander incorporating a sandpaper clamp mechanism according to the present invention.

FIG. 1 shows a finishing tool known as an orbital finishing sander for fine-finish sanding of a wood workpiece, for example. The orbital finishing sander includes a sanding sheet or sandpaper 1 placed over a platen or pad 2 attached to the lower surface of a bottom plate 3. The bottom plate 3 is operatively connected to a motor (not shown) in a body 20 through a belt and pulley mechanism 21 for moving the sanding sheet 1 in an orbital path. A grip 22 is connected to the body 20 so that the operator can hold the grip 22 during operation of the orbital finishing sander. The bottom plate 3 is supported on a frame 9 spaced upwardly therefrom and joined to the lower end of the body 20. The bottom plate 3 is connected to the frame 9 by a drive shaft 23 of the belt and pulley mechanism 21 and rubber legs 8 (see also FIG. 2). The rubber legs 8 allow the bottom plate 3 and hence the platen 2 to make orbital motion with respect to the frame 9.

The sanding sheet is clamped at its opposite ends to the ends of the bottom plate 3 and hence the platen 2 by means of a pair of sandpaper holders 4 positioned on the respective ends of the bottom plate 3.

Figure 2:
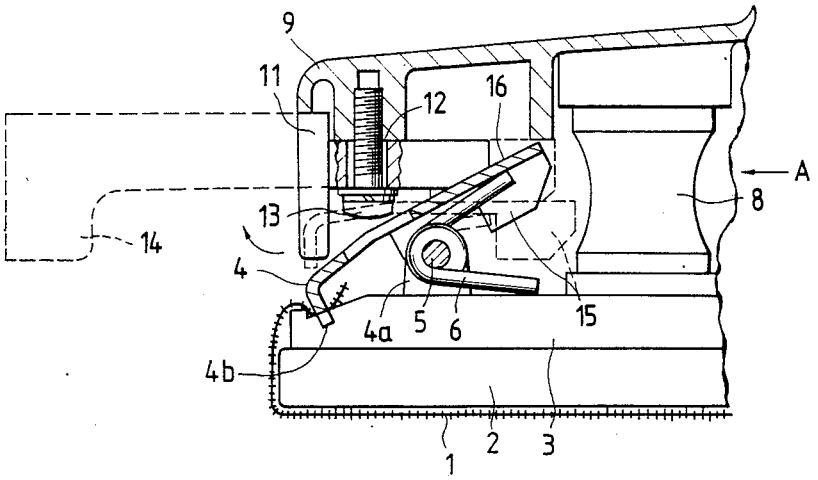
FIG. 2 is an enlarged fragmentary cross-sectional view of the sandpaper clamp mechanism.
Figure 4:
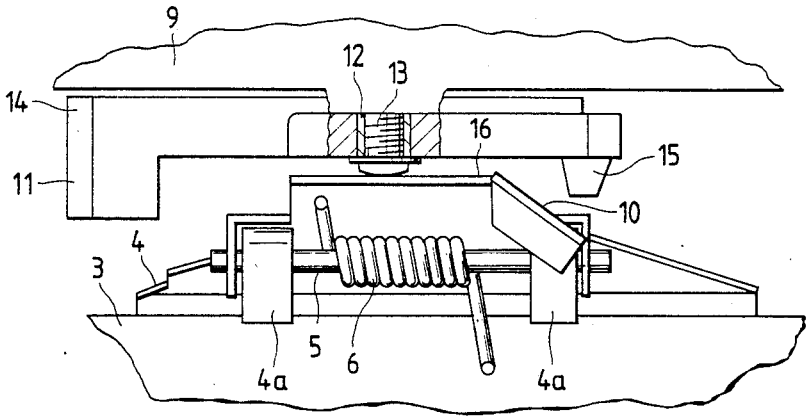
FIG. 4 is a fragmentary elevational view of the sandpaper clamp mechanism as viewed in the direction indicated by the arrow A, showing a sandpaper holder in a clamping position.

As shown in FIGS. 2 and 4, each of the sandpaper holders 4 is angularly movably supported on a shaft 5 mounted on a pair of legs **4*a* fixed to the upper surface of the bottom plate 3. The sandpaper holder 4 has gripping teeth 4*b* on its front lower end for gripping the sanding sheet 1. A torsion coil spring 6 is disposed around the shaft 5 and has opposite ends engaging the sandpaper holder 4 and the bottom plate 3 for normally urging the gripping teeth 4*b* to hold the sanding sheet 5 down against the upper surface of the bottom plate 3**.

Figure 3:
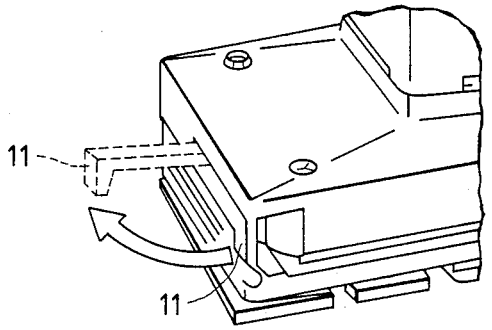
FIG. 3 is a fragmentary perspective view showing the manner in which the sandpaper clamp mechanism operates.
Figure 5:
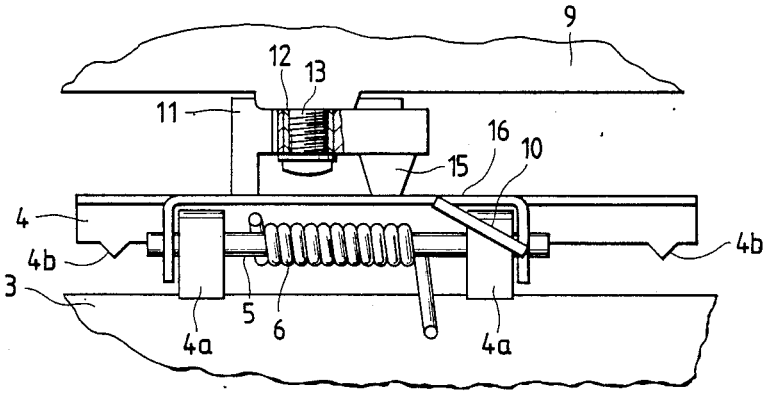
FIG. 5 is a fragmentary elevational view similar to FIG. 4, but showing the sandpaper holder in a releasing position.

As illustrated in FIG. 4, the sandpaper holder 4 has a slanted surface 10 which is inclined downwardly toward one end of the shaft 5, i.e., one side of the sandpaper holder 4. A lever 11 is rotatably supported at its substantially intermediate portion on the frame 9 by means of a vertical sleeve 12 and a screw 13 which fastens the sleeve 12 to the frame 9. The lever 11 is horizontally angularly movable about the axis of the sleeve 12. The lever 11 has a handle 14 on one end and a presser 15 on the other end, the presser 15 projecting downwardly below the position of a flat surface 16 of the sandpaper holder 4 remote from the gripping teeth 4b when the sandpaper holder 4 is in the solid-line position in FIG. 2. The lever 11 is movable through about 90° between the position in FIG. 4 (i.e., the solid-line position in FIGS. 2 and 3) and the position in FIG. 5 (i.e., the dotted-line position in FIGS. 2 and 3).

When the lever 11 is in the position shown in FIG. 4, the presser 15 is spaced from the slanted surface 10, and the sandpaper holder 4 is biased by the spring 6 to cause the gripping teeth 4b to grip the sanding sheet 1 against the bottom plate 3 as shown in FIG. 2. When the operator grips the handle 14 with fingers and turns the lever 11 toward the position shown in FIG. 5, the presser 15 engages the slanted surface 10 and moves onto a flat surface 16 contiguous to the slanted surface 10c, while camming the flat surface 16 downwardly until the gripping teeth 4b are lifted away from the bottom plate 3. Then, the gripped end of the sanding sheet 1 can be released from between the sandpaper holder 4 and the bottom plate 3. With the lever 11 left in the dotted-line position in FIGS. 2 and 3, one end of a new sanding sheet can easily be inserted between the sandpaper holder 4 and the bottom plate 3. Since the operator is not required to hold the lever 11 by hand, the operator can place the new sanding sheet accurately in position with both hands. Thereafter, the lever 11 moved by hand back to the position in FIG. 4, whereupon the sandpaper holder 4 is automatically turned into the sanding sheet gripping position under the bias of the spring 6 as indicated by the solid lines in FIG. 2. The new sanding sheet 1 is therefore firmly gripped in position by the gripping teeth 4b.

Although a certain preferred embodiment has been shown and described, it should be understood that many changes and modifications may be made therein without departing from the scope of the appended claims.

What is claimed is:

1. A sandpaper clamp mechanism for use in a finishing tool, comprising:

a frame;

a bottom plate connected to said frame in spaced relation thereto;

a platen for supporting a sanding sheet thereon, said platen being attached to a lower surface of said bottom plate;

a sandpaper holder angularly movably mounted on said bottom plate, said sandpaper holder having gripping teeth on one end, a flat surface remote from said gripping teeth, and a slanted surface contiguous to said flat surface, said sandpaper holder being angularly movably between a first position in which said gripping teeth hold the sanding sheet against said bottom plate and a second position in which said gripping teeth are spaced from said bottom plate to release the sanding sheet;

a spring acting between said sandpaper holder and said bottom plate for normally urging said sandpaper holder into said first position; and a lever angularly movably mounted on said frame and having a presser on one end thereof, said lever being angularly movable between a third position in which said presser is spaced from said slanted-surface to allow said sandpaper holder to remain in said first position under the bias of said spring and a fourth position in which said presser pushes said flat surface to lift said sandpaper holder into said second position, said presser successively camming said slanted and flat surfaces while said lever is moving from said third position to said fourth position.

2. A sandpaper clamp mechanism according to claim 1, wherein said lever is supported on said frame by a sleeve attached to said frame by a screw, said lever being angularly movable about the axis of said sleeve through approximately 90°.

3. A sandpaper clamp mechanism according to claim 1, wherein said lever has a handle on the other end thereof.

4. A sandpaper clamp mechanism according to claim 1, wherein said slanted surface is inclined toward said bottom plate in a direction to one side of the sandpaper holder.

* * * * *